US010030904B2

(12) United States Patent
Becke et al.

(10) Patent No.: US 10,030,904 B2
(45) **Date of Patent: *Jul. 24, 2018**

(54) DOOR FOR REFRIGERATOR AND REFRIGERATOR

(71) Applicant: BSH HAUSGERAETE GMBH, Munich (DE)

(72) Inventors: Christoph Becke, Grosskarolinenfeld (DE); Max Eicher, Munich (DE); Klaus Foersterling, Amerang (DE); Christine Hartwein, Nandlstadt (DE); Andreas Kessler, Munich (DE); Philipp Kleinlein, Munich (DE); Ralph Staud, Munich (DE); Thomas Tischer, Haar (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/327,094

(22) PCT Filed: Jul. 17, 2015

(86) PCT No.: PCT/IB2015/055419

§ 371 (c)(1),
(2) Date: Jan. 18, 2017

(87) PCT Pub. No.: WO2016/009394

PCT Pub. Date: Jan. 21, 2016

(65) Prior Publication Data

US 2017/0176091 A1 Jun. 22, 2017

(30) Foreign Application Priority Data

Jul. 18, 2014 (CN) ..... 2014 1 0346323

(51) Int. Cl.
*A47B 96/04* (2006.01)
*F25D 23/02* (2006.01)
*F25D 29/00* (2006.01)

(52) U.S. Cl.
CPC ..... *F25D 23/028* (2013.01); *F25D 29/005* (2013.01); *F25D 2323/021* (2013.01); *F25D 2400/361* (2013.01)

(58) Field of Classification Search
CPC ..... F25C 23/028; F25D 23/028
(Continued)

(56) References Cited

U.S. PATENT DOCUMENTS 8,714,673 B2 * 5/2014 Kim ..... F25D 23/02 312/405
2009/0289536 A1 * 11/2009 Park ..... F25D 23/028 312/405

(Continued)

FOREIGN PATENT DOCUMENTS

CN 2699206 Y 5/2005
DE 102012200810 A1 7/2013

(Continued)

*Primary Examiner* — Matthew W Ing
(74) *Attorney, Agent, or Firm* — Laurence A. Greenberg; Werner H. Stemer; Ralph E. Locher

(57) ABSTRACT

A refrigerator door includes an inner door liner, a front wall and a user interface housing connected to the front wall. The user interface housing, the inner door liner, the front wall and a heat insulation layer are combined together. The user interface housing has an accommodating space for accommodating a user interface electrical module. The user interface electrical module can be placed into the accommodating space or removed from the accommodating space from a side of the door. The door has a handle groove and a handle piece detachably connected to the door. The handle groove and the handle piece are located within the user interface housing and the handle piece divides the handle groove from the accommodating space. The user interface housing
(Continued)

includes a concave portion being opened forward and the handle groove is accessible though the concave portion. A refrigerator having the door is also provided.

11 Claims, 5 Drawing Sheets

(58) Field of Classification Search
USPC ..... 312/7.2, 401, 405, 405.1, 408
See application file for complete search history.

(56) References Cited

U.S. PATENT DOCUMENTS

| | | | | |
|---|---|---|---|---|
| 2010/0107679 | A1* | 5/2010 | Park | F25D 23/028 62/441 |
| 2012/0326587 | A1 | 12/2012 | Jeong et al. | |
| 2014/0246970 | A1 | 9/2014 | Park et al. | |
| 2015/0052920 | A1* | 2/2015 | Park | F25D 29/005 62/126 |
| 2015/0292793 | A1* | 10/2015 | Bischoff | F25D 23/028 312/404 |
| 2015/0308158 | A1* | 10/2015 | Jeon | E05B 65/0042 312/405 |

FOREIGN PATENT DOCUMENTS

| | | | |
|---|---|---|---|
| EP | 2184571 | A2 | 5/2010 |
| EP | 2538160 | A2 | 12/2012 |
| JP | 2003247774 | A | 9/2003 |
| JP | 2013178054 | A | 9/2013 |
| JP | 2013178055 | A | 9/2013 |
| WO | 2010060726 | A2 | 6/2010 |

* cited by examiner

DOOR FOR REFRIGERATOR AND REFRIGERATOR

BACKGROUND

Technical Field

The present invention relates to a door for a refrigerator and a refrigerator, and in particular, to a door for a household refrigerator, and a household refrigerator having such a door.

Related Art

CN 2699206 Y discloses a refrigerator door. The refrigerator door includes a front wall, an inner door panel, and a door cover. The front wall, the inner door panel, and the door cover are combined together by using a foaming heat insulation layer filled between the front wall and the inner door panel. The front wall has an edge opening and the edge opening is enclosed by the door cover. The door cover has a concave portion recessing towards the heat insulation layer. A detachable decorative panel is installed on the door, a rear side of the decorative panel has an accommodating space, the decorative panel and control and display assemblies are preassembled to form a preassembled unit, and the preassembled unit is fixed on the door after a foaming process of the door.

JP 2013-178054 A discloses a refrigerator door, including a door body having a heat insulation layer. A user interface apparatus is disposed at an intermediate area along a longitudinal direction of the door body, and is located behind a glass plate of the door body. A step piece recessing a front surface is formed on a side cover of a right end portion of the door body portion. The step piece encloses an accommodating room accommodating the user interface apparatus. A handle piece protruding towards the right side is installed on an installation surface of a side surface facing the step piece, by using a screw. A handle groove extending along the entire height of the door is formed between the handle piece and the step piece. A front surface of the handle portion is covered by a protective cover clamped between a front end of the handle portion and the step piece. The protective cover is formed by using a transparent resin molding piece.

SUMMARY

An objective of the present invention is to overcome at least one of technical problems in the prior art, to provide an improved door for a refrigerator and a refrigerator having such a door.

The foregoing objective can be achieved by characteristics in independent claims. Preferable embodiments of the present invention are the subject of the accompanying drawings, the specification, and dependant claims.

An aspect of the present invention relates to a door. The door includes a door inner liner, a front wall, and a user interface housing connected to the front wall, where the user interface housing, the door inner liner, the front wall, and a heat insulation layer are combined together, the user interface housing has an accommodating space for accommodating a user interface electrical module, and the user interface electrical module can be placed into the accommodating space or removed from the accommodating space from a side of the door; and the door further includes a handle groove, and a handle piece detachably connected to the door, characterized in that the handle groove and the handle piece are located within the user interface housing, the handle piece divides the handle groove from the accommodating space, the user interface housing includes a concave portion opened forward, and the handle groove is accessible via the concave portion.

Thus, both the user interface electrical module and a handle function may be disposed inside the common user interface housing, so that a user electrical interface and the handle function may form one visible integral unit. Further, when the common user interface housing is used for carrying the handle function and a user electrical interface function, a quantity of components of a preassembled unit for a subsequent foaming process may be reduced, and it is accordingly easier to prevent foaming agent from leaking between the user interface housing and the front wall and/or a side wall.

In a possible embodiment, the concave portion may be disposed close to a longitudinal side of the door. In an alternative embodiment, the concave portion is disposed close to a horizontal side portion of the door, for example, the concave portion is disposed on the top or at the bottom.

The user interface electrical module may include an input unit for receiving a user input instruction and/or an output unit displaying information to a user. The user interface electrical module may be located entirely inside the accommodating space, or may also be located partially inside the accommodating space, and partially outside the accommodating space. These two conditions both fall within a protection scope of claims of the present invention.

The so called "handle piece being detachable" refers to that the handle piece can be disassembled from the door, with/without a tool, without damaging the door, and the handle piece may be installed on the door for a next time. When the handle piece is disassembled, the user interface module may be removed from the accommodating space or placed into the accommodating space.

At least a part of a boundary of the handle groove may be defined by the handle piece. For example, a complete handle groove is formed inside the handle piece, or a part (for example, a front boundary) of the boundary of the handle groove is defined by the handle piece.

The front wall is located in front of the door inner liner. In a possible embodiment, the front wall forms at least a majority part of a front surface of the door, that is, the front wall is exposed outside. In another possible embodiment, the door may further include a decorative panel located in front of the front wall. Such a decorative panel may be made of, for example, glass or a material similar to the glass.

In a possible embodiment, the front wall is formed by using a single component, for example, the front wall may be formed by using a piece of sheet metal. In another possible embodiment, the front wall may also be formed by multiple components, and these components may form a corresponding part of the front wall in its entirety or in a part. In the latter case, a first opening is constituted together by openings formed on different components.

In a possible embodiment, the side wall is a longitudinal side wall, for example a left wall or a right wall, of the door. In another possible embodiment, the side wall may also be a transverse side wall, for example a top wall or a bottom wall, of the door.

Other independent characteristics or those characteristics that are considered as features of the present invention through combination with other characteristics will be described in the following appended claims.

In a possible embodiment, the door may include a front panel covering the user interface electrical module and the handle piece. Because the user interface electrical module and the handle piece are covered by the common front panel, a front area covering the handle piece and the user interface electrical module is continuous and seamless between each other, so that a font surface of the door is concise, and it is particularly advantageous that the concave portion and the user interface that can indicate a position of the handle groove may form together an integral visible unit.

In a possible embodiment, the front panel may have an edge opening that is located in front of the concave portion to expose the concave portion. In a manner of disposing the edge opening on the front panel, the front panel may cover an area other than the concave portion, including an edge area of the door on the same side of the concave portion. This is advantageous to simplify a structure of the door and have a concise appearance.

Another aspect of the present invention relates to a door for a refrigerator. The door includes a user interface electrical module; an accommodating space for accommodating the user interface electrical module, where the accommodating space is accessible via a side of the door; a handle groove close to the accommodating space; a concave portion opened forward, where the handle groove is accessible via the handle groove; and a front panel located in front of the user interface electrical module, characterized in that the handle groove is located behind the front panel, and the front panel has an edge opening located in front of the concave portion to expose the concave portion.

Because the user interface electrical module and the handle piece are both located behind the common front panel, a front area covering the handle piece and the user interface electrical module may be continuous and seamless, so that a font surface of the door is concise, and it is particularly advantageous to make the concave portion and the user interface that can indicate a position of the handle groove form a visible unit as a whole. In addition, by disposing the edge opening on the front panel, the front panel may cover an area other than the concave portion, including an edge area of the door on the same side of the concave portion. This is advantageous to simplify a structure of the door and have a concise appearance.

In a possible embodiment, the door may include a handle piece that is detachably connected to the door to enclose the accommodating space, where the handle piece includes a handle portion covered by the front panel. Thus, the handle piece not only forms the handle portion to prevent a user from directly exerting force on a rear side of the front panel, but also may close the accommodating space to prevent the user from putting a finger into the accommodating space.

In a possible embodiment, the accommodating space, the handle groove, and the concave portion may be located within a common user interface housing, and the user interface housing is fixedly attached to a heat insulation layer of the door.

Although the front panel may be directly fixedly attached to the heat insulation layer, in a preferred embodiment, the door may include a door body, the front panel is connected to the door body, the door body includes a front wall fixedly attached to the heat insulation layer, the front wall is provided with a first opening, the user interface housing is connected to the front wall, and the accommodating space and the concave portion are opened towards the first opening.

In a possible embodiment, an adhesion means arranged on the front wall along the first opening is included, where the adhesion means is adhered to the front panel and the front wall.

In a possible embodiment, the user interface housing is connected to a side wall, the side wall is provided with a second opening in communication with the first opening, and the concave portion is accessible via the first opening and the second opening.

The side wall may be a longitudinal side wall, for example, a left wall or a right wall, of the door. In an alternative embodiment, the side wall is a transverse side wall, for example, a top wall or a bottom wall, of the door. The front wall and the side wall may be made independently and then is assembled together. In an alternative embodiment, the front wall and the side wall may also be formed by different parts of a single component.

In a possible embodiment, the edge opening has a shape of a rectangle.

In a possible embodiment, at least a majority part of a front surface of the door is formed by the front panel. In a possible embodiment, the entire front surface of the door is formed by the front panel, for example, an edge area of the front panel is completely exposed outside. In an alternative embodiment, the front panel forms the majority part of the front surface of the door, for example, an edge area of the front panel is covered and hidden by another component or an edge area of the front surface of the door is formed by another component.

In a possible embodiment, the accommodating space, the handle groove, and the concave portion are disposed side by side sequentially along a depth direction of the handle groove. Because the concave portion, the handle groove, and the user interface electrical module are distributed side by side sequentially along the depth direction of the handle groove, and do not overlap in a length direction of the handle groove, each of them may have a greater length in a bounding box as needed. Thus, while the door can have a compact operation center, the concave portion and the handle groove may have enough lengths, so that a user may conveniently put a hand into the handle groove and grab the handle portion to open the door. Similarly, a user electrical interface of a user operation center may occupy a larger size of the door. When the concave portion and the handle groove are disposed close to a longitudinal side of the door, for example, close to a left side or a right side of the door, the depth direction of the handle groove is a transverse direction of the door, or when the concave portion and the handle groove are disposed close to a transverse side of the door, for example, located on the top or at the bottom of the door, a depth direction of the handle groove is a length direction of the door (which may also be referred to as a height direction).

In a possible embodiment, the user interface housing includes a rear wall fixedly attached to the heat insulation layer, and the rear wall defines rear boundaries of the handle groove and the concave portion, so that the concave portion and the handle groove may have a continuous rear boundary. In addition, because the rear boundaries of the concave portion and the handle groove are directly formed by the user interface housing, this helps to increase the size of the concave portion and the handle groove, along a thickness direction of the door.

Another aspect of the present invention relates to a refrigerator, where the refrigerator includes the door according to any one of the items.

It should be understood that the door according to the present invention is applicable to refrigerators having various different structures, and should not be limited to the preferred embodiments disclosed in the present invention. For example, the present invention is applicable to a double door refrigerator having a first storage compartment and a second storage compartment that are distributed side by side, is applicable to a refrigerator having a first storage compartment and second storage compartment that are distributed along a height direction, and is also applicable to a refrigerator having a pair of doors that closes a same storage compartment.

A storage compartment of the refrigerator may be used for storing food and/or wine, for example, the refrigerator may have at least one storage compartment merely for storing wine.

The door may be a rotatable door pivotally connected to a refrigerator body, or may also be a drawer-like door that can be connected to a body in a pushing or pulling manner.

The door may close one or more storage compartments of the refrigerator, or may also close a part of one or more storage compartments.

The structure of the present invention and other inventive objectives and beneficial effects of the present invention become more comprehensible through the description of preferred embodiments with reference to the accompanying drawings.

BRIEF DESCRIPTION OF THE DRAWINGS

As a part of this specification and for further understanding of the present invention, the following accompanying drawings describe specific implementation manners of the present invention, and are used to describe the principle of the present invention together with the specification.

DETAILED DESCRIPTION

Figure 1:
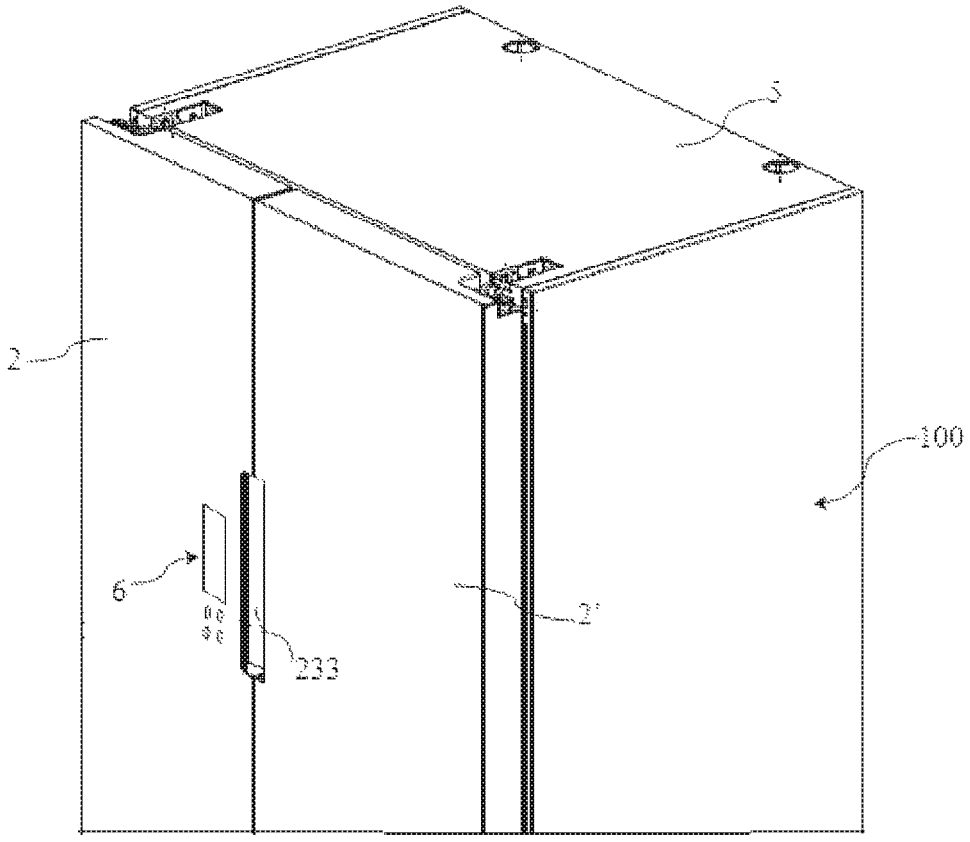
FIG. 1 is a schematic partial perspective view of a refrigerator according to a preferred embodiment of the present invention.

FIG. 1 shows a schematic perspective view of a refrigerator 100 according to a preferred embodiment of the present invention. As shown in FIG. 1, the refrigerator 100 includes a body 5 having a first storage compartment (not shown in the figure) and a second storage compartment (not shown in the figure) that are disposed side by side. The refrigerator 100 further includes a pair of doors 2 and 2' that are opened towards each other and are connected to the body 5 to close corresponding storage compartments.

Referring to FIG. 2, FIG. 3, and FIG. 7-5 together with FIG. 1, the door 2 has an integrated operation center 6. The operation center 6 includes a user interface 61 and a handle groove 232 integrated inside the operation center 6. When the door 2 is opened or closed, a user may put a hand into the handle groove 232. The operation center 6 further includes a concave portion 233, and the user puts the hand into the handle groove 232 through the concave portion 233.

The handle groove 232 and the concave portion 233 extend along only a partial length of door 2, and remain spaces between a top surface 203 and a bottom surface of the door 2, along a length direction of the concave portion 233.

The operation center 6 is disposed on a side of the door 2 opposite to the other door 2'. In this embodiment, the door 2' also has a concave portion and a handle groove (not shown in the figure) that is approached from the concave portion. Concave portions on the pair of doors 2 and 2' are oppositely disposed, and have a same length.

The user interface 61 is set for accepting input and output information of the user, and these pieces of information include, for example, setting information about the refrigerator 100, and/or information about food stored in the refrigerator 100, or the like.

Figure 2:
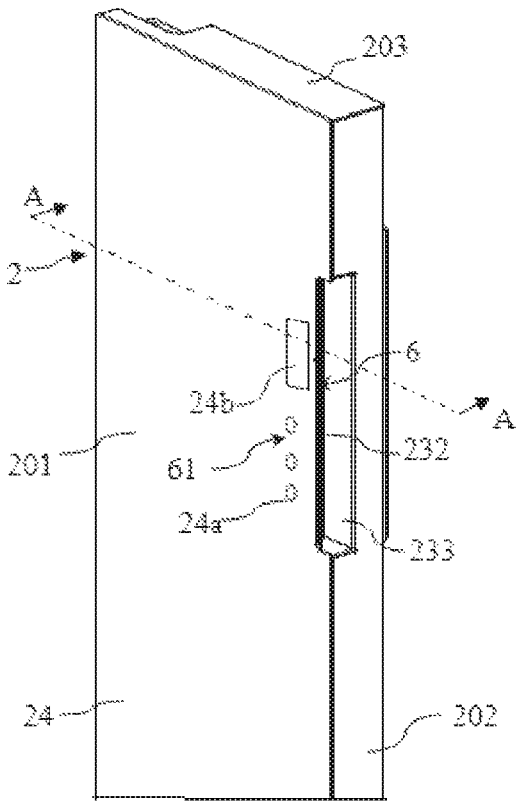
FIG. 2 is a schematic partial perspective view of a door according to a preferred embodiment of the present invention.

The user interface 61 includes multiple touch areas **24*a* and display areas 24*b* (shown in only FIG. 1). As shown in FIG. 2, the touch area 24*a* may be divided from the display area 24*b*, or may also be located within the display area 24*b***.

The user interface 61 includes a user interface electrical module 25 located behind the touch areas **24*a* and the display areas 24*b*. The user interface electrical module 25 includes a light source, and when the light source is turned on, light may pass through the display areas 24*b***.

The display areas **24*b* may also be transparent when the light source is turned off. Then, in another embodiment, when the light source is turned off, light cannot pass through the display areas 24*b*. In this case, when the light source is turned off, the front panel 24 may be set in a manner that there is no visual limitation on the display area 24*b* and another area of the front panel 24**.

In addition to electrical components, the user interface electrical module 25 may also include a carrying member for carrying these electrical components.

Figure 5:
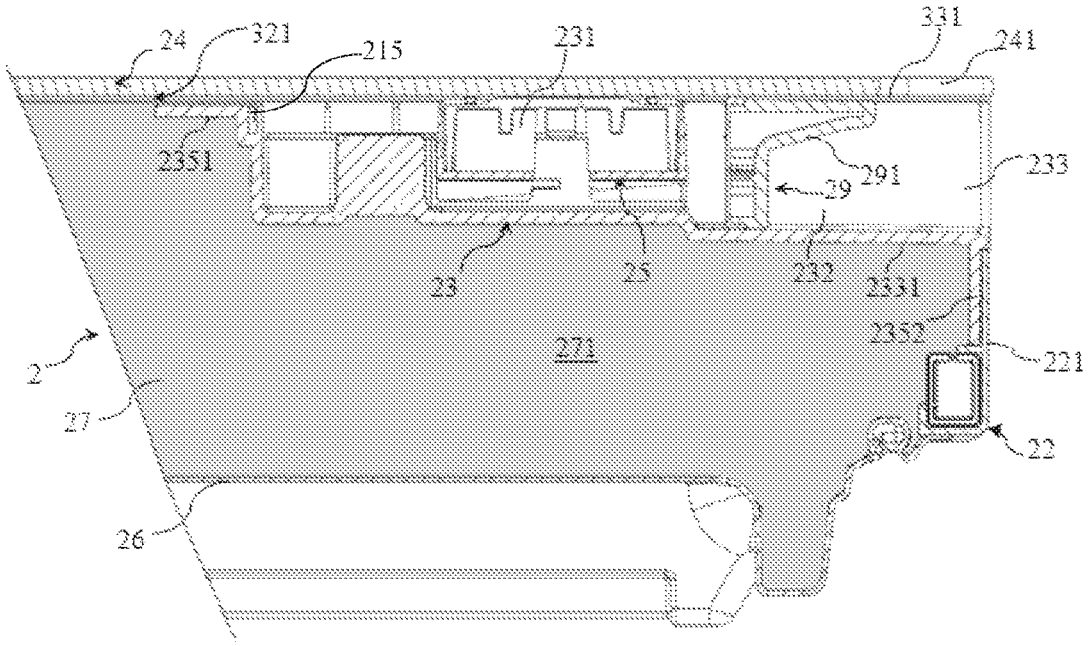
FIG. 5 is a partial sectional view along an A-A line in FIG. 2.

As shown in FIG. 5, the concave portion 233 is opened towards a front surface 201 and a side surface 202 of the door 2. The concave portion 233, the handle groove 232, and the user interface electrical module 25 are arranged side by side along a depth direction (which is also a transverse direction of the door 2 in this embodiment) of the handle groove 232.

In a front view of the door 2, visual elements such as the touch areas **24*a* and the transparent display areas 24*b*, the handle groove 232, and the concave portion 233 of the use interface 61 are disposed side by side sequentially in the transverse direction of the door 2**.

The door 2 includes a door body 20 having a heat insulation layer 27, and a one-piece front panel 24 covers the front of the door body 20. The front panel 24 forms a majority part of the front surface 201 of the door 2.

The front panel 24 may be made of glass or resin similar to glass in the appearance. The front panel 24 may be adhered to the door body 20 by using an adhesion means 242 disposed around at least a front edge of the door body 20. The adhesion means 242 may be, for example, adhesive tape or glue.

On a rear side of the front panel 24, the door body 20 has an accommodating space 231 for accommodating the user interface electrical module 25. The user interface electrical module 25 and the handle groove 232 are both located behind the front panel 24 and are covered by the front panel 24. The touch areas **24*a* and the display areas 24*b* are formed by the front panel 24. The user interface electrical module 25 is connected to the rear side of the front panel 24, for receiving an instruction input by the user by using the front panel 24**.

The accommodating space 231 has an entrance opened towards the handle groove 231. The entrance may be enclosed by a handle piece 29 detachably connected to the door body 20. After the front panel 24 is fixed to the door body 20, before the handle piece 29 is fixed to the door body 20, or after the handle piece 29 is disassembled from the door body 20, the user interface electrical module 25 may be inserted into the accommodating space 231 or removed from the accommodating space 231 through the concave portion 233 and the handle groove 232. The handle groove 232 is located between the concave portion 233 and the accommodating space 231.

The front panel 24 has an edge opening 241 on a side corresponding to the user interface 61. The edge opening 241 is located right in front of the concave portion 233 to expose the concave portion 233.

The edge opening 241 may have a shape adapted to the concave portion 233, so that the concave portion 233 is exposed to a front side of the door 2, and may be approached from the front of the door 2. In this embodiment, the concave portion 233 is also exposed to a right side of the door 2 and may be approached from the right side of the door 2.

The handle piece 29 is connected to the door body 20 through the concave portion 233. The handle piece 29 includes a handle portion 291, and after the user puts a hand into the handle groove 232, fingers of the user may grab the handle portion 291.

In a direction from the font to the back, the handle piece 29 may be completely covered by the front panel 24, and the handle portion 291 is located between the handle groove 232 and the front panel 24. When the door is opened, some fingers of the user press a rear surface of the handle portion 291, and another finger (for example, a thumb) may press on the front panel 24 located in front of the handle portion 291, thereby forcing the door 2 to be opened.

Figure 3:
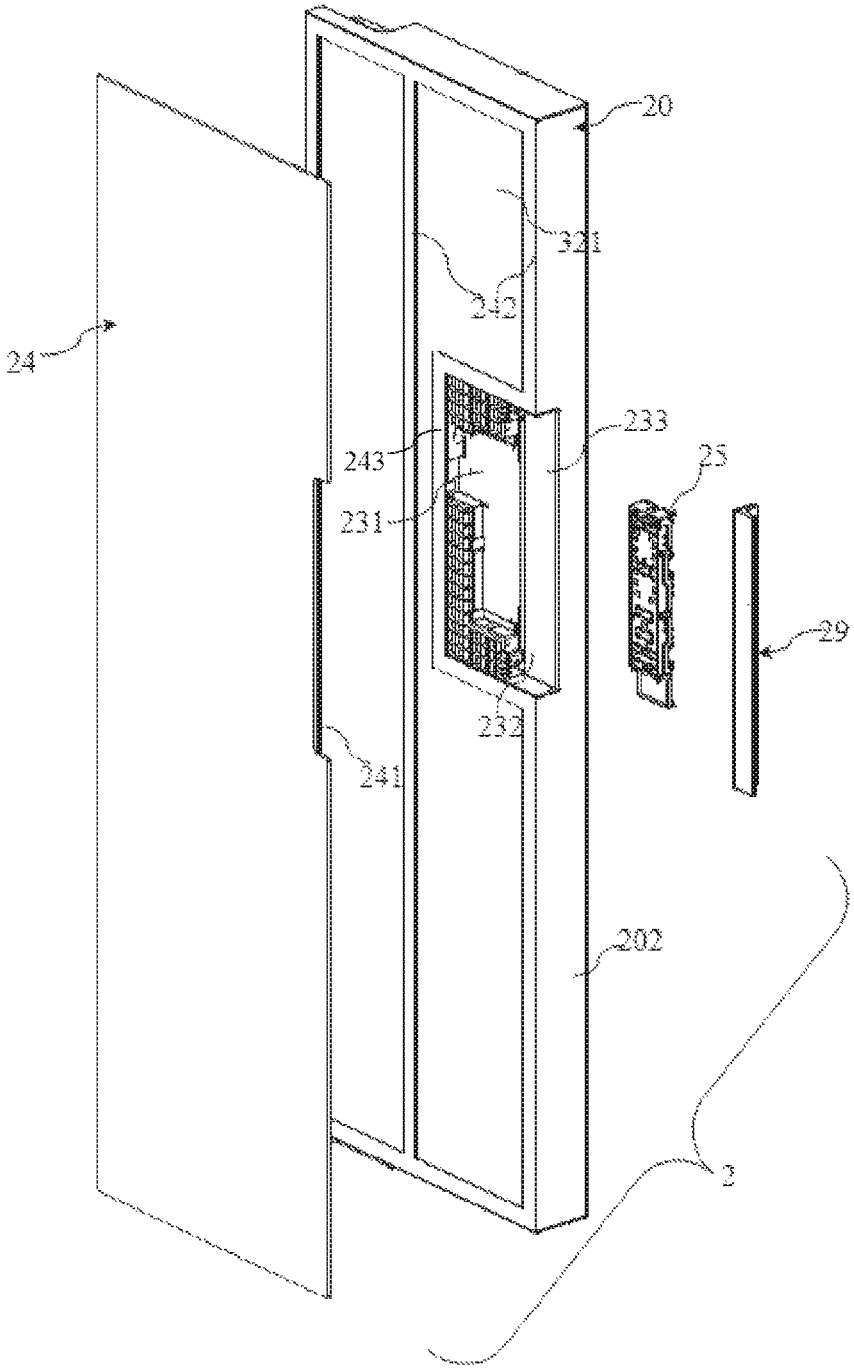
FIG. 3 is a partial exploded view of a door according to a preferred embodiment of the present invention.
Figure 4:
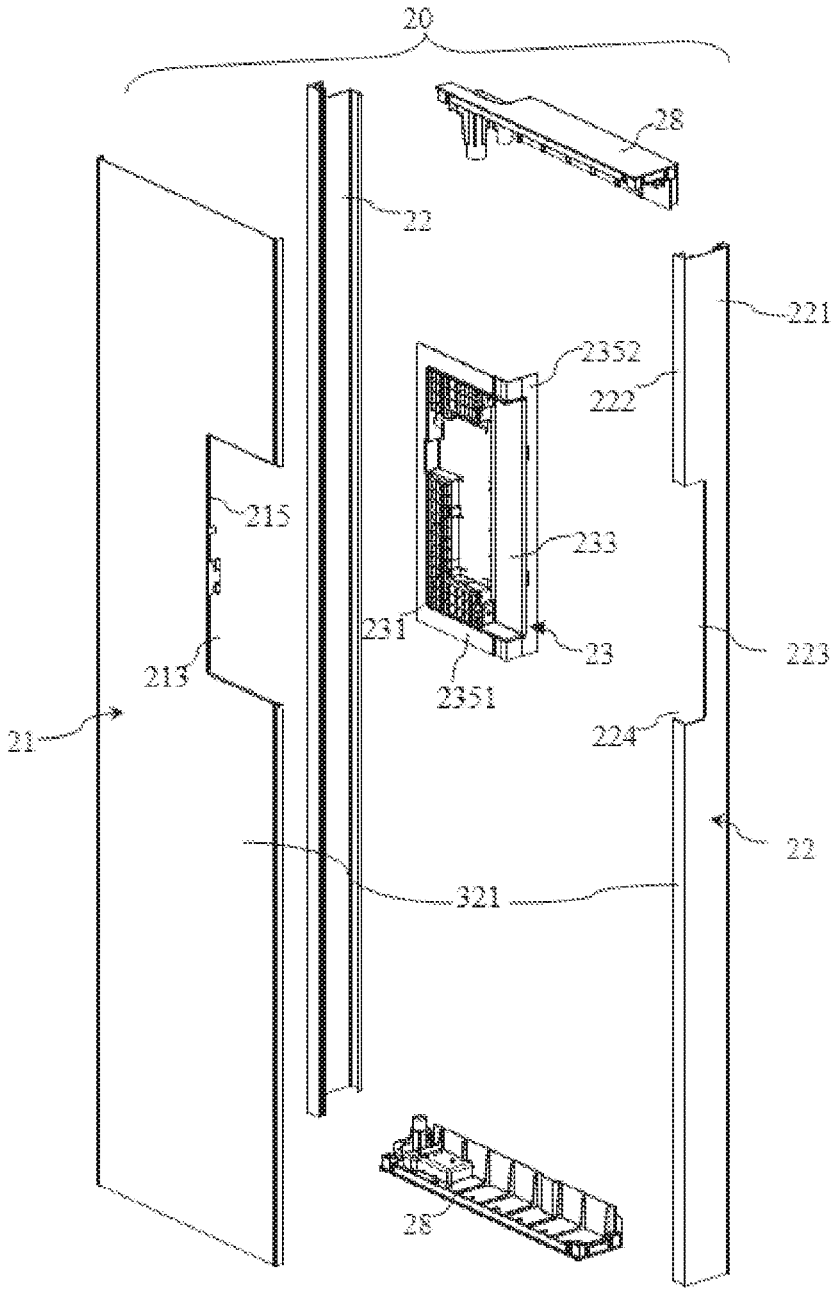
FIG. 4 is a partial exploded view of a door body according to a preferred embodiment of the present invention.

Referring to FIG. 3, FIG. 4, and FIG. 5, a door body 20 includes a sheet metal 21, a pair of doorjambs 22 connected to corresponding longitudinal sides of the sheet metal 21, upper and lower end caps 28 connected respectively to an upper end and a lower end of the sheet metal 21, and a user interface housing 23 connected to the sheet metal 21 and a corresponding doorjamb 22. The heat insulation layer 27 is filled inside a heat insulation space 271 surrounded by the sheet metal 21, the doorjambs 22, the end caps 28, the user interface housing 23, and a door inner liner 26. The sheet metal 21, the doorjambs 22, the end caps 28, the user interface housing 23, and the door inner liner 26 are undetachably fixed together by the heat insulation layer 27.

In this embodiment, each doorjamb 22 has a side wall 221 that forms a main part of doorjamb 22, and a front strip 222 that is connected to a front end of the side wall 221 and extends inward.

The sheet metal 21 is connected to the doorjamb 22, so that the front strip 222 together with the sheet metal 21 forms a front wall 321, which is located in front of an inner container 26, of the door body 20. Each front strip 222 is located at one corresponding side of the sheet metal 21.

The front wall 321 has a first opening 331 (shown in FIG. 5), where the first opening 331 is formed by a first opening portion 213 located on the sheet metal 21 together with a second opening portion 224 located on a right doorjamb 22.

The side wall 221 has a second opening 223, the first opening 331 and the second opening 223 are in communication at a connection corner of the front wall 321 and the side wall 221.

The user interface housing 23 is connected to the front wall 321 and the side wall 221, so as to enclose the first opening 331 and the second opening 223 for the heat insulation space 271, that is, the heat insulation space 271 may be enclosed at the first opening 331 and the second opening 223 because of the user interface housing 23.

In this embodiment, the user interface housing 23 has a first connection flange 2351 for being connected to a rear surface of the front wall 321 and a second connection flange 2352 for being connected to an inner surface of the side wall 221. The sheet metal 21 may have a connection flange 215 disposed along the first opening portion 211 and the connection flange 215 is inserted into the user interface housing 23.

The user interface housing 23 is approximately box-shaped, for accommodating a user interface electrical module 25 and a handle groove 232 and a concave portion 233 are located within the user interface housing 23.

The user interface housing 23 includes at least a part of an accommodating space 231 for receiving the user interface electrical module 25. The accommodating space 231 is opened towards the first opening 331, so that the user interface electrical module 25 may be in contact with the front panel 24.

The concave portion 233 is formed by a part, which approaches the side wall 221, of the user interface housing 23. The concave portion 233 is opened towards the first opening 331 and the second opening 223, to be exposed to a front surface 201 and a right surface 202 of the door, so that the user may approach, through the concave portion 233, the handle groove 232 located within the user interface housing 23.

The handle groove 232, the concave portion 233, and the accommodating space 231 may have different depths in a thickness direction of the door 2.

As shown in FIG. 5, the handle groove 232 and the rear boundary of the concave portion 233 may be defined by a continuous and smooth rear wall 2331, so that the handle groove 232 and the concave portion 233 have the continuous rear boundary. The rear wall 2331 may be integrally formed on the user interface housing 23, and is combined together with the heat insulation layer 27.

A length of the concave portion 233 may be equal to or less than a length of the first opening 331. In an embodiment, a relationship of the front wall 321 and the user interface housing 23 may be properly arranged, for example, the front wall 321 has an end edge extending into the user interface housing 23 and forming the concave portion, so that the length of the concave portion 233 may be accurately equal to the length of the first opening 331, or in an alternative embodiment, the length of the concave portion is slightly less than the length of the first opening, for example, the user interface housing 23 has a wall of an end edge for forming the concave portion, where the end boundary is located within the first opening 331 and is close to the edge of the first opening 331.

After a foaming process of the door body 20 is completed, the front panel 24 is adhered to the door body 20. In addition that the adhesion means 242 is disposed along an edge area of the door body 20, the adhesion means 242 further includes an adhesion part 243 distributed on the front wall 321 by surrounding the first opening 331, to adhere to the front panel 24 and the front wall 321 by surrounding the first opening 331.

In summary, the accommodating space 231, the handle groove 232, and the concave portion 233 are all located within the user interface housing 23. The concave portion 233, the handle groove 232, and the accommodating space 231 are disposed side by side sequentially along the depth direction of the handle groove 232. In the depth direction of the handle groove 232, the handle groove 232 is located between the accommodating space 231 and the concave portion 233.

Various embodiments for describing each single part with reference to FIG. 1 to FIG. 5 may be combined in any given manner to achieve the advantages of the present invention. In addition, the present invention is not limited to the shown embodiments, and generally means other than the shown means may be used, as long as they can achieve the same effect.

What is claimed is:

1. A refrigerator door, comprising:

a side of the door;

a forward direction of the door;

a user interface electrical module;

an accommodating space for accommodating said user interface electrical module, said accommodating space being accessible from said side of the door;

a concave portion being open in said forward direction of the door;

a front panel disposed in front of said user interface electrical module, said front panel having an edge opening disposed in front of said concave portion to expose said concave portion; and a handle groove disposed in a vicinity of said accommodating space, said handle groove being disposed behind said front panel, and said handle groove being accessible through said concave portion.

2. The door according to claim 1, which further comprises a handle piece being detachably connected within the door for closing said accommodating space, said handle piece including a handle portion being covered by said front panel.

3. The door according to claim 1, which further comprises:

a heat insulation layer; and a user interface housing being fixedly attached to said heat insulation layer;

said accommodating space said handle groove and said concave portion being disposed together within said user interface housing.

4. The door according to claim 3, which further comprises a door body connected to said front panel, said door body including a front wall fixedly attached to said heat insulation layer, said front wall having a first opening, said user interface housing being connected to said front wall, and said accommodating space and said concave portion being open towards said first opening.

5. The door according to claim 4, which further comprises an adhesive disposed on said front wall along said first opening, said adhesive adhering to said front panel and said front wall.

6. The door according to claim 4, which further comprises a side wall of the door, said user interface housing being connected to said side wall, said side wall having a second opening in communication with said first opening, and said concave portion being accessible through said first opening and said second opening.

7. The door according to claim 1, wherein said edge opening has a rectangular shape.

8. The door according to claim 1, which further comprises a front surface of the door, at least a majority part of said front surface being formed by said front panel.

9. The door according to claim 1, wherein said handle groove defines a depth direction, and said accommodating space, said handle groove and said concave portion are disposed side by side sequentially along said depth direction of said handle groove.

10. The door according to claim 3, wherein said user interface housing includes a rear wall fixedly attached to said heat insulation layer, and said rear wall defines rear boundaries of said handle groove and said concave portion.

11. A refrigerator, comprising the door according to claim 1.

* * * * *